United States Patent [19]

Berg

[11] Patent Number: 4,579,379

[45] Date of Patent: Apr. 1, 1986

[54] ELEVATOR/SPIDER WITH IMPROVED LOCKING MECHANISM

[75] Inventor: Gunnar H. Berg, Austin, Tex.

[73] Assignee: Hughes Tool Company, Houston, Tex.

[21] Appl. No.: 569,811

[22] Filed: Jan. 11, 1984

[51] Int. Cl.[4] ..... E21B 19/07

[52] U.S. Cl. ..... 294/102.2

[58] Field of Search ..... 294/90, 102 R, 102 A; 188/67

[56] References Cited

U.S. PATENT DOCUMENTS

| | | | |
|---|---|---|---|
| 2,030,087 | 2/1936 | Young et al. | 294/90 |
| 3,149,391 | 9/1964 | Boster | 294/102 A |
| 4,275,488 | 6/1981 | Gray | 294/102 A |
| 4,361,940 | 12/1982 | McFadden | 294/102 A X |

OTHER PUBLICATIONS

BJ-Hughes, Inc., "Replacement Parts Manual for Slip Type Elevator Spider", pp. 11-13.

*Primary Examiner*—Johnny D. Cherry
*Attorney, Agent, or Firm*—Robert A. Felsman; H. Dennis Kelly

[57] ABSTRACT

An elevator/spider having a series of slips in a tapered bowl and a yoke for pivotally setting the slips. A lock rod, having a hole, is connected to the yoke and extends downward into a locking mechanism. The locking mechanism has a lock plunger which can be moved into or out of the hole in the lock rod, to lock the lock rod in a downward position and the slips in an upward, retracted position. The lock plunger is moved by a key, cooperative with a key slot in the lock plunger. The key is attached to a cam, which is rotated by a handle. The cam also has a cam surface which can contact the lock rod to hold the lock rod and the slips down.

4 Claims, 9 Drawing Figures

ELEVATOR/SPIDER WITH IMPROVED LOCKING MECHANISM

BACKGROUND OF THE INVENTION

1. Field of the Invention

This invention relates in general to well casing handling equipment, and in particular to well casing elevators and spiders.

2. Description of the Prior Art

In a typical derrick arrangement, a traveling block is suspended from the derrick crown block by a series of cables, which are driven by the derrick drawworks to raise and lower the traveling block along the vertical axis of the derrick. The usual derrick hook is suspended from the traveling block and supports an elevator by means of links. When handling casing, slip-type elevators are used. Such elevators have a tapered interior bowl and a series of gripping slips, which are pivotally moved up and down within the bowl to grip the exterior surface of the casing being handled.

A casing spider rests on the derrick floor and supports the casing string in the well bore by means of slips, which are set to grip the casing exterior. A new joint of casing is raised into position over the well bore by the casing elevator, and the lower end of the casing joint is connected to the upper end of the casing string in the well bore. The elevator is then stripped down over the top of the casing joint and the slips are set to grip the casing exterior. The elevator is then used to lift the casing string, releasing the slips of the lower spider, and the casing string is lowered into the well bore. The slips of the spider are then set to support the casing string in the well bore, and the elevator is disengaged and stripped upward and off of the casing to allow another casing joint to be moved into position. This cycle is repeated until all of the casing is run in the well bore.

Elevator/spiders are powerful, double-duty tools designed to handle long, heavy casing strings. These tools are convertible and can be used either as casing spiders or as elevators. Often, when handling casing strings, these tools will be used in tandem, utilizing one tool as a casing spider and the other tool as an elevator.

Elevator/spiders generally have slips which are pivotally operable between an upper, retracted position and a lower, gripping position. The slips are moved between the upper and lower positions by means of fluid cylinders. In a typical arrangement, a yoke is connected to the slips by suitable linkages. The yoke pivots about a pivot axis in the approximate center of the yoke when the fluid pressure is applied to the cylinders. During normal raising or lowering of the slips, the fluid cylinders serve to retain the slips in the upper or lower position. The rate of raising or lowering the slips can be controlled by providing an adjustable air flow valve in the air distribution system leading to the fluid cylinders.

Elevator/spiders also typically have a locking mechanism to lock the slips in the upper, retracted position. If the slips should fall to the lower gripping position while pipe is being raised or lowered through the elevator/spider, the movement of the pipe would be impeded and damage may occur to the drilling equipment. Mechanical locking mechanisms in the prior art are susceptible to the jarring and vibration which occurs on a typical drilling platform. Therefore, there was a need to provide a more reliable locking mechanism for the elevator/spider.

SUMMARY OF THE INVENTION

The improved elevator/spider has a lock rod attached to the yoke. The lock rod extends downward from the yoke into the locking mechanism. The lock rod has a small hole into which a lock plunger fits. The lock plunger is moved into and out of the hole in the lock rod by a handle pivotally attached to the body of the elevator/spider. The handle of the invention has a cam attached to one end. A small key has a square end fitted into the cam, and a rounded end fitted within a key slot in the lock plunger. As the handle is rotated on the body, the key acts as a single-tooth gear to move the lock plunger inward or outward. A spring biases the lock plunger away from the lock rod, and a back stop limits the distance that the lock plunger may move away from the lock rod. An over-center spring biases the handle towards one or the other extreme of the handle's movement. The handle also has a locking cam surface on one extreme end. When the lock plunger is removed from the hole in the lock rod, the lock rod moves upwards to allow the slips to lower to the gripping position. When the handle is moved upward towards the extreme of its movement, the locking cam surface contacts the lock rod to hold the rod in the upward position. This locks the slips in the lower gripping position.

The above, as well as additional objects, features, and advantages of the invention, will become apparent in the following detailed description.

DETAILED DESCRIPTION OF THE PREFERRED EMBODIMENT

Figure 1:
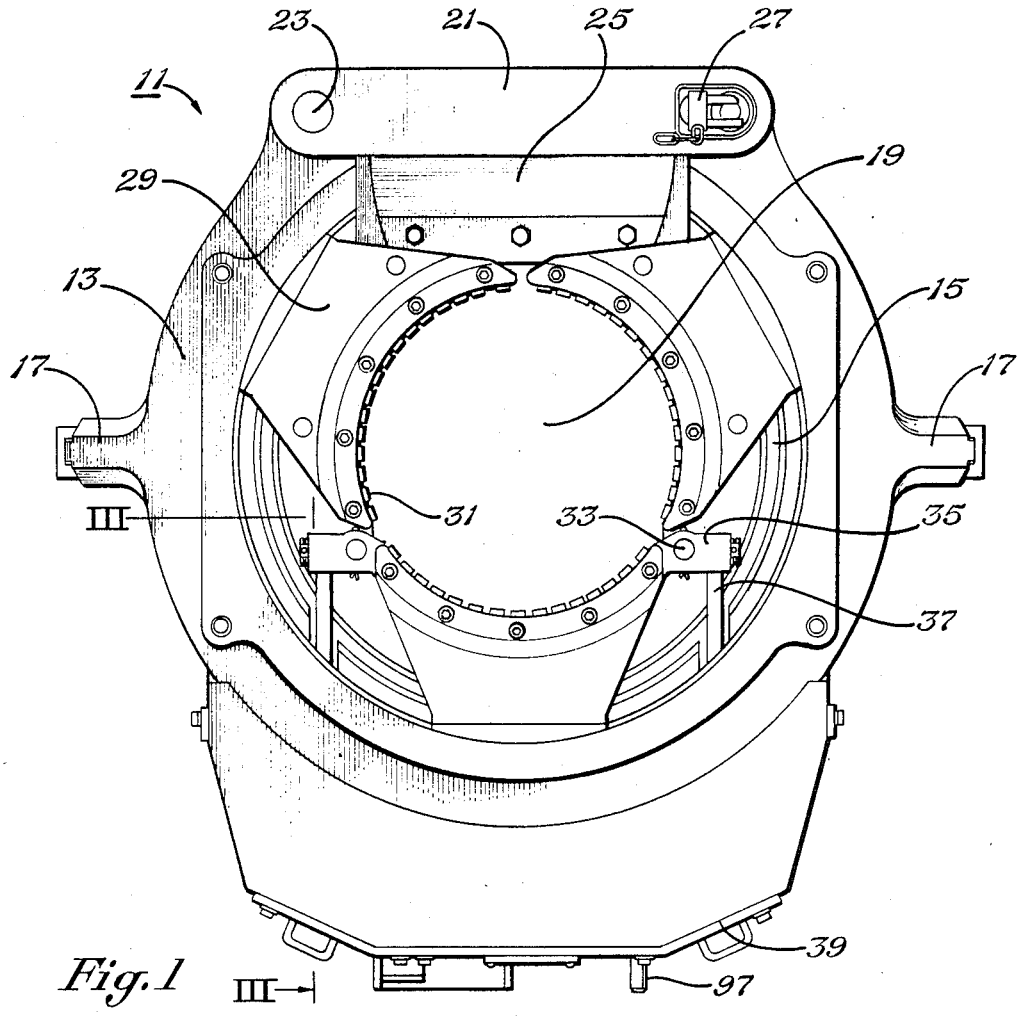
FIG. 1 is a top view of the an improved elevator/spider.

FIG. 1 illustrates an elevator/spider, designated generally as 11, having a cylindrical body 13 with a tapered interior bowl 15. A pair of ears 17 are provided on the sides of the body 13, so that the elevator 11 may be suspended from a derrick hook by means of links. A central bore 19 receives a section of pipe, casing, or tubing. A side gate 21, which pivots about a point 23 on one side of a gate opening 25, provides radial access to the bore 19. The side gate 21 is secured to the body 13 by means of a latch mechanism 27 on the opposite side of opening 25. Three matching slips 29 are seated in the tapered bowl 15. Each slip 29 has gripping teeth 31, on the interior face, which are equally spaced about the vertical axis passing through the center of bore 19.

Figure 2:
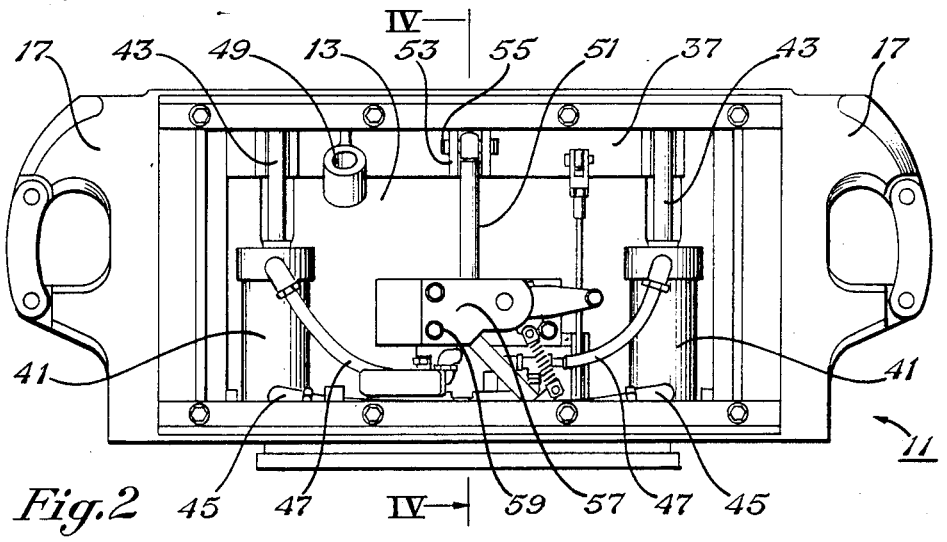
FIG. 2 is a side view of the elevator/spider, with the cover removed.

Each of the slips 29 is connected for pivotal movement by means of pins 33 and linkages 35 to a yoke 37. FIG. 2 shows the elevator/spider 11 with the rear cover 39 removed. A pair of fluid cylinders 41 are mounted on the body 13 and have output shafts 43 connected to the yoke 37. When fluid pressure is applied through fluid conduits 45 to the lower ends of the fluid cylinders 41, the output shafts 43 extend upwards, raising the yoke 37. Likewise, when fluid pressure is applied through fluid conduits 47 to the upper ends of the fluid cylinders 41, the output shafts 43 retract downward, lowering the yoke 37. A socket 49 is provided on the yoke 37, so that a lever can be inserted and the yoke 37 can be raised and lowered manually.

A lock rod 51 is attached to the yoke 37 by means of a clevis 53 and a pin 55. The lock rod 51 extends downward into a locking mechanism 57, which is attached to the body 13 by means of bolts 59.

Figure 3:
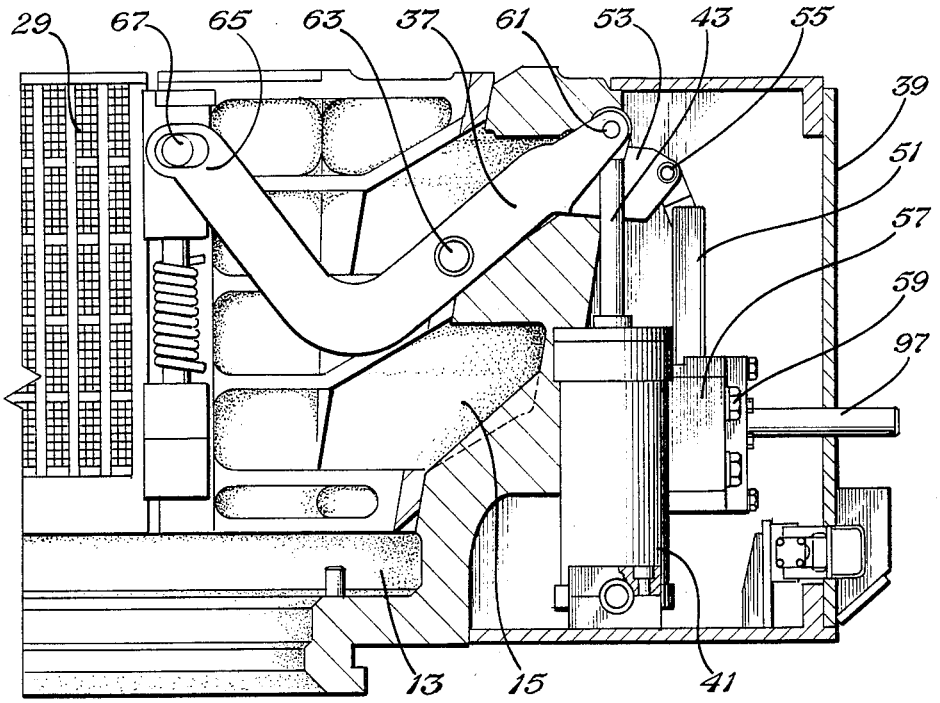
FIG. 3 is a sectional view as seen along lines III—III in FIG. 1.
Figure 4:
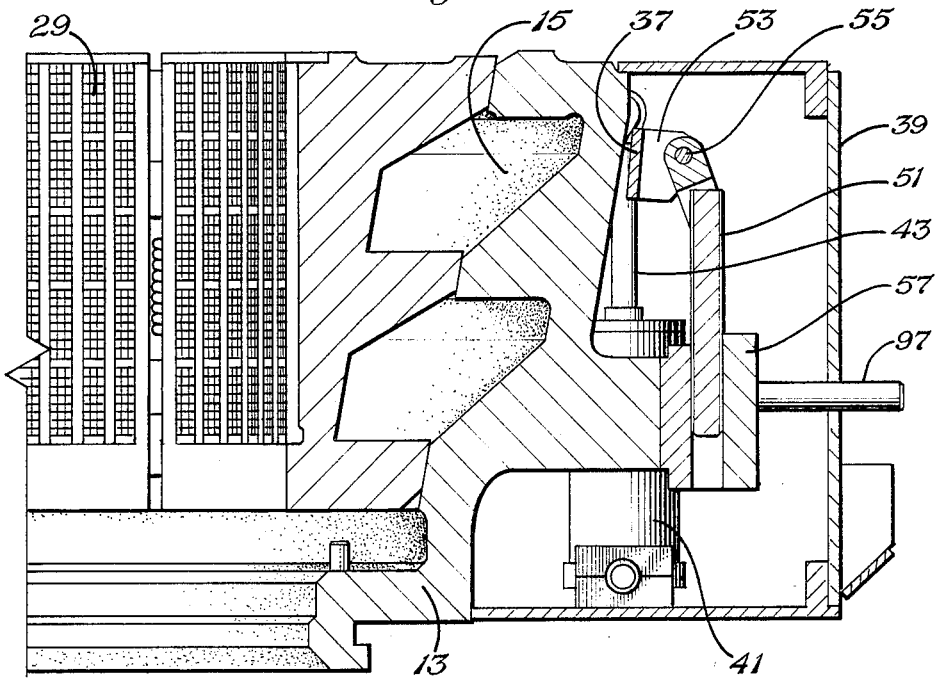
FIG. 4 is a sectional view as seen along lines IV—IV in FIG. 2.

FIGS. 3 and 4 are sectional views of the elevator/spider 11. The output shafts 43 are connected to the yoke 37 by pin 61. As the output shaft 43 moves up and down, the yoke 37 pivots about the pivot point 63. The extreme end 65 of the yoke 37 is attached to the slips 29 by means of pin 67. As the output shaft 43 moves upward, the yoke 37 pivots about point 63 and lowers the slip 29. Likewise, when output shaft 43 moves downward, the yoke 37 pivots in the opposite direction, and raises the slips 29. As the slips 29 are raised, the slips 29 move upward in the bowl 15. Thus, as the slips 29 are moved upward, the slips 29 are also retracted. As the slips 29 are moved downward, the slips 29 are moved inward to a gripping position.

Figure 5:
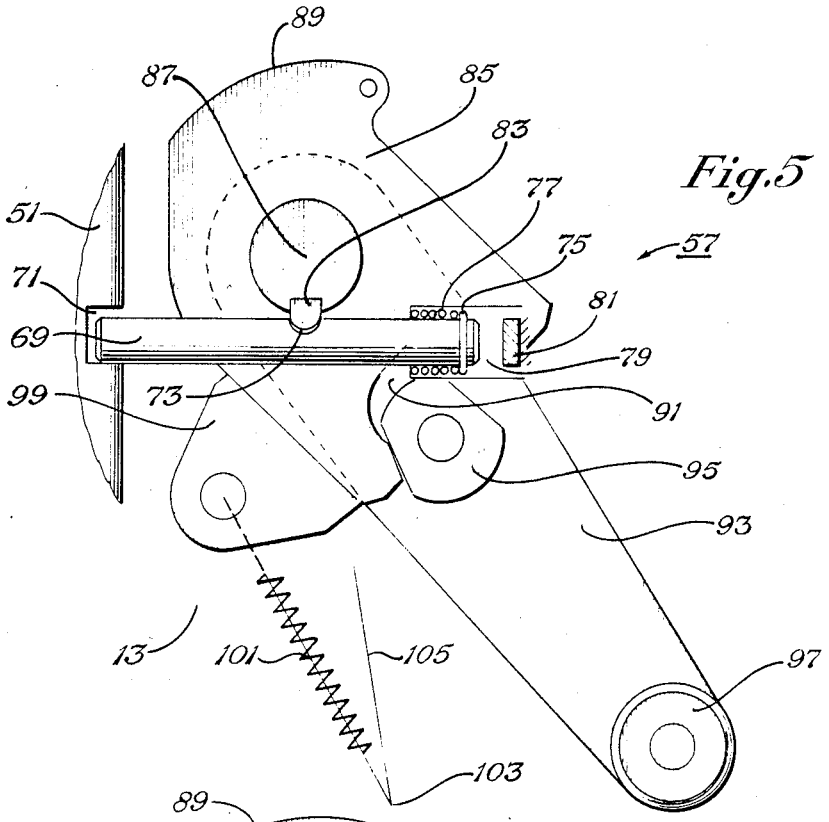
FIG. 5 is a view of the locking mechanism when the slips are locked in the upper position.

In FIG. 5, the locking mechanism 57 is shown locking the slips in the upper retracted position. A lock plunger 69 extends into a hole 71 in the lock rod 51, to hold the lock rod 51 in the downward position. The hole 71 is a locking means, cooperative with the lock plunger 69, for preventing movement of the lock rod 51, whenever the lock plunger 69 is in the hole 71, and for releasing the lock rod 51, whenever the lock plunger 69 is retracted. A semicircular key slot 73 is located at the approximate midpoint of the lock plunger 69. At the extreme end of the lock plunger 69, away from the lock rod 51, a spring retainer 75 holds a compression spring 77 in a spring cavity 79. A back stop 81 is located at the end of the spring cavity 79. A small key 83 extends into the key slot 73 to hold the lock plunger 69 in the hole 71 in the lock rod 51. The key 83 is attached to a cam 85 which is pivotally attached to the body 13 of the elevator/spider 11 at pivot point 87. The key 83 and the key slot 73 are a connection means for moving the lock plunger 69 reciprocally in response to pivotal movement of the handle 93.

The cam 85 has a curved surface 89 at one end and a U shaped slot 91 at the other end. A handle 93 is pivotally attached to the body 13 at the same pivot point 87 as the cam 85. The handle 93 has a projection 95 which extends into the U shaped slot 91 in the cam 85. The handle 93 also has a grip 97, at the extreme end of the handle 93, which extends away from the body 13 beyond the cover 39 to provide a convenient hand-hold. A flange 99 extends downward from the lower edge of the handle 93, and one end of an over-center spring 101 is attached to the flange 99. The other end of the over-center spring 101 is pivotally attached to a pivot point 103 on the body 13. A line 105 is drawn between the pivot point 103 of the over-center spring 101 and the pivot point 87 of the handle 93. When the over-center spring 101 is positioned to the left of line 105, the over-center spring 101 tends to push the handle 93 in a clockwise direction. The over-center spring 101 thus acts as over-center means for biasing the handle 91 in a clockwise direction, thus biasing the lock plunger 69 toward the lock rod 51.

Figure 6:
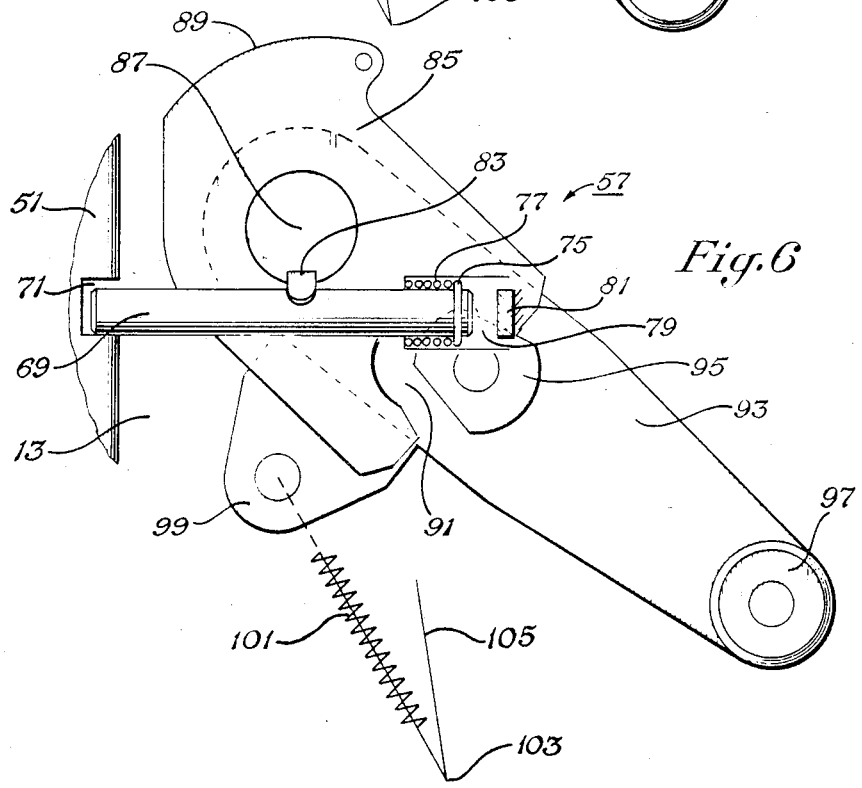
FIG. 6 is a view of the locking mechanism when the handle has been raised to take up the slack.

When the slips are to be unlocked and lowered to the lower gripping position, the first step is as illustrated in FIGS. 5 and 6. The grip 97 is grasped by an operator and raised until the projection 95 moves from the lower side of the U shaped slot 91 to the other side. The locking mechanism 57 is now in the position illustrated in FIG. 6.

Figure 7:
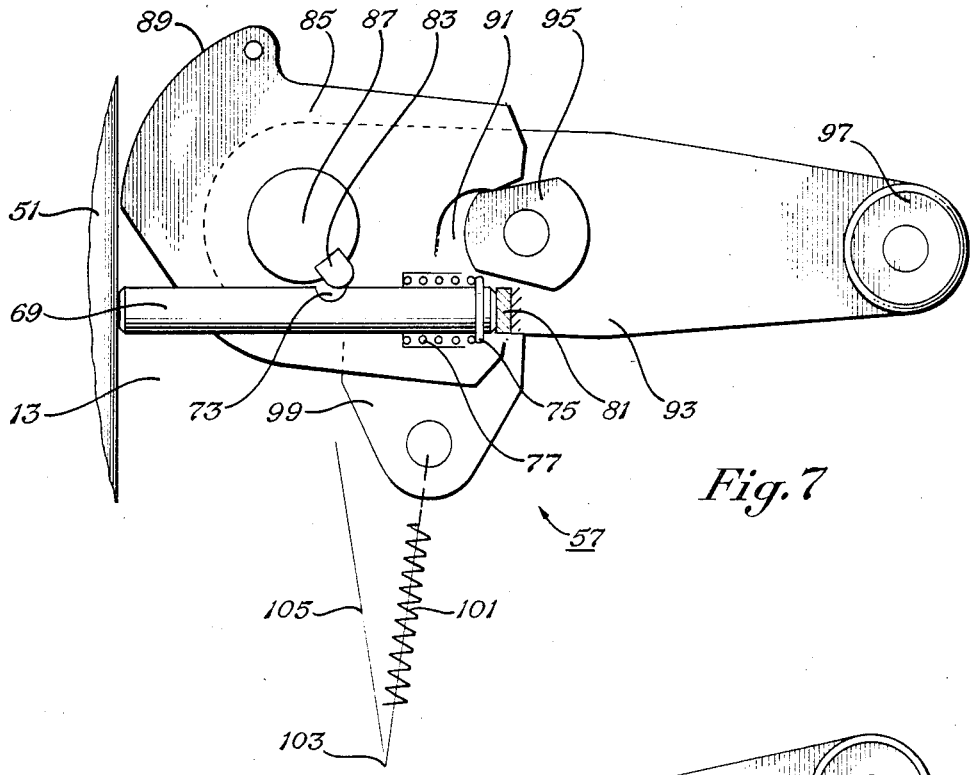
FIG. 7 is a view of the locking mechanism when the lock plunger has been removed from the lock rod allowing the slips to fall to the lower position.

Once the slack in the handle 93 has been taken up, the projection 95 begins to move the cam 85. As the cam 85 rotates in a counterclockwise direction, the key 83 acts as a single tooth gear to pull the lock plunger 69 from the hole 71 in the lock rod 51. As the key 83 disengages from the lock plunger 69, the spring 77 acts as bias means for biasing the lock plunger 69 toward the back stop 81. The back stop 81 acts as stop means for restricting the distance that the lock plunger 69 may move away from the lock rod 51. The spring 77 and the back stop 81 hold the lock plunger 69 so that the key slot 73 remains in position to receive the key 83. The over-center spring 101 is pivoted to the right side of the line 105, so that the over-center spring 101 now biases the handle 93 in the counterclockwise direction. The position of the locking mechanism 57 is now as illustrated in FIG. 7. When the lock plunger 69 has been removed from the hole 71 in the lock rod 51, the lock rod is allowed to move upwards and the slips 29 are allowed to move downward into the lower gripping position.

Figure 8:
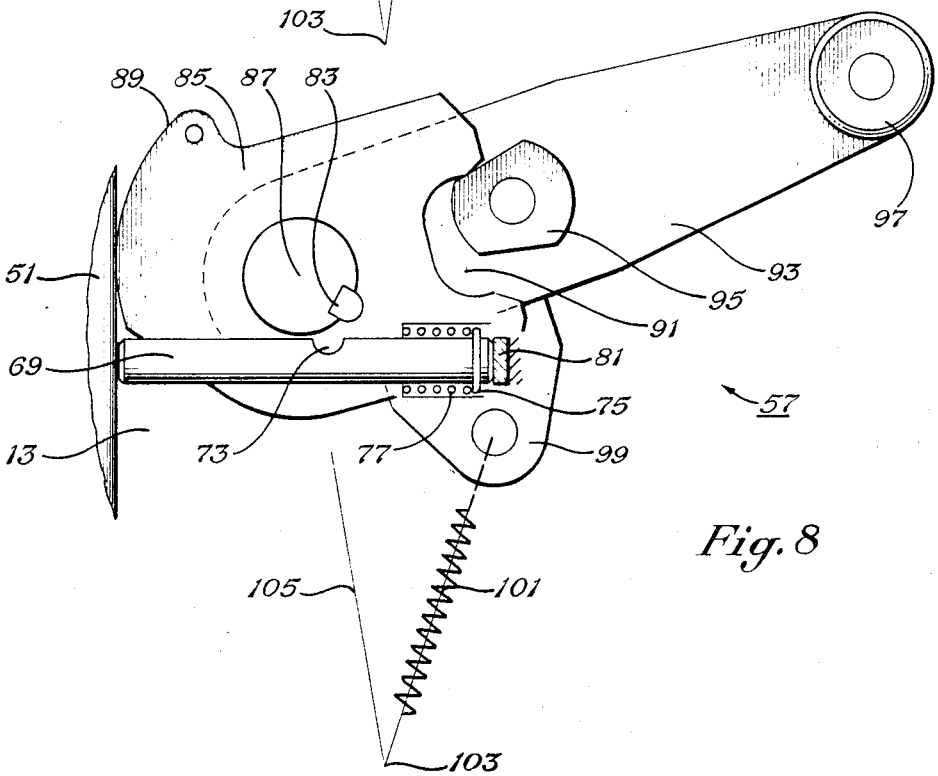
FIG. 8 is a view of the locking mechanism when the slips are locked in the lower position.
Figure 9:
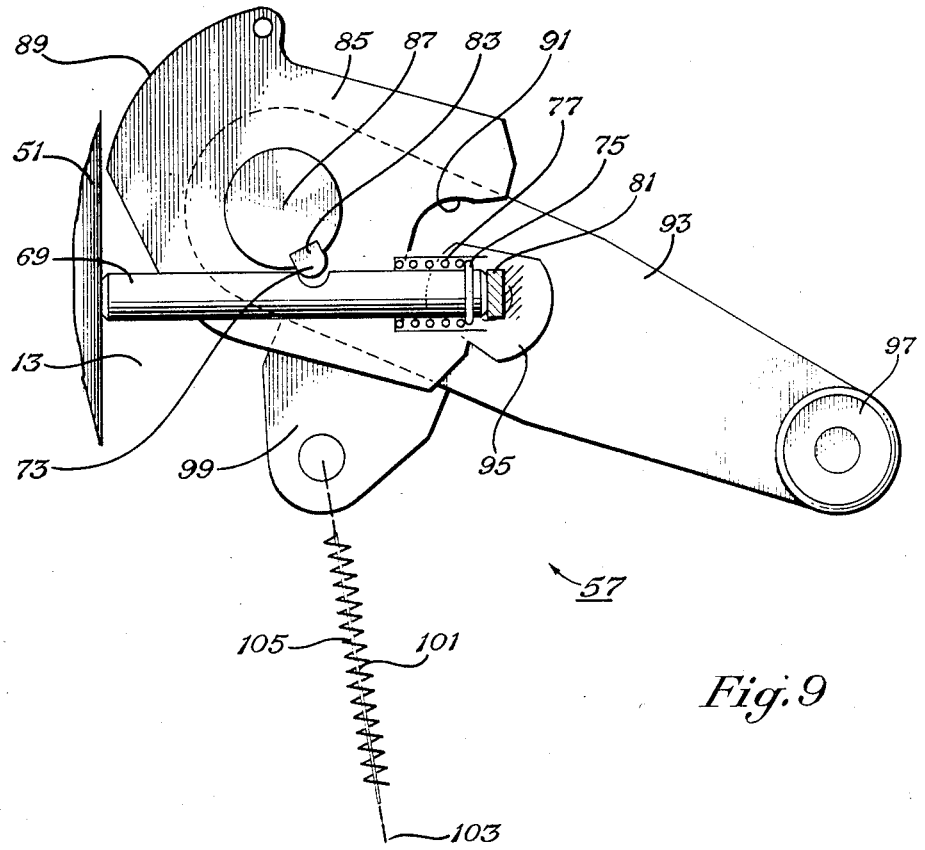
FIG. 9 is a view of the locking position when the slips are being raised to the upper position.

To hold the slips 29 in the gripping position, the handle 93 is rotated an additional distance in the counterclockwise direction. As the cam 85 is rotated, the curved surface 89 of the cam 85 contacts the lock rod 51 and holds the lock rod 51 in its upward position. If force is applied to the slips 29 in the upward direction, such as by casing being raised through the opening 19, the lock rod 51 will apply a downward force against the curved surface 89 of the cam 85. This force will cause the cam 85 to rotate an additional distance in the counterclockwise direction, thus placing an additional locking pressure against the lock rod 51. The orientation of the locking mechanism 57 is now as illustrated in FIG. 8.

In order to raise the slips 29 again, the handle 93 is rotated in a clockwise direction to disengage the curved surface 89 of the cam 85. The key 83 reengages the key slot 73 in the lock plunger 69, and again acts as a single tooth gear, but now moves the lock plunger 69 toward the lock rod 51. The end of the lock plunger 69 will slide against the lock rod 51 until the hole 71 in the lock rod 51 is aligned with the lock plunger 69. When the hole 71 and the lock plunger 69 are aligned, the over-center spring 101 will force the handle 93 to move in the clockwise direction thus moving the lock plunger 69 into the hole 71. The lock rod 51 is again locked in the downward position, and the slips 29 are again locked in their upward, retracted position.

The elevator/spider 11 of the invention has several significant advantages over the prior art. The lock plunger 69 provides a positive locking force to hold the lock rod 51 in the lower position, so that the elevator/spider 11 is not susceptible to the jarring and vibration of the well platform. The curved surface 89 of the cam 85 provides a locking force to hold the lock rod 51 in the upper position and to hold the slips 29 in their lower gripping position. The relative simplicity of the locking mechanism 57 provides for economical manufacture and reliability of service.

While the invention has been shown in only one of its forms, it should be apparent to those skilled in the art that it is not so limited, but is susceptible to various changes and modifications without departing from the spirit thereof.

I claim:

1. An improved elevator/spider, comprising:

a body;

a series of slips in a tapered bowl;

a slip-setting yoke for pivotally setting the slips;

a lock rod connected at one end to the yoke;

a handle pivotally attached to the body;

a lock plunger, reciprocally mounted to move in a straight line between a locked position, in which the lock plunger prevents movement of the lock rod, and a released position, in which the lock plunger allows movement of the lock rod;

connection means for moving the lock plunger reciprocally in response to pivotal movement of the handle;

bias means for biasing the lock plunger toward the released position; and stop means for restricting the distance the lock plunger can move away from the lock rod.

2. An improved elevator/spider, comprising:

a body;

a series of slips in a tapered bowl;

a slip-setting yoke for pivotally setting the slips;

a lock rod connected at one end to the yoke;

a handle pivotally attached to the body;

a lock plunger, having a key slot, and reciprocally mounted to move in a straight line between a locked position and a released position;

locking means, on the lock rod and cooperative with the lock plunger, for preventing movement of the lock rod whenever the lock plunger is in the locked position, and for releasing the lock rod whenever the lock plunger is moved to the released position;

a key, carried by the handle, and cooperative with the key slot of the lock plunger, for moving the lock plunger reciprocally in response to pivotal movement of the handle;

a spring for biasing the lock plunger toward the released position; and stop means for restricting the distance the lock plunger can move away from the lock rod.

3. A locking mechanism for an elevator/spider of the type having a body, a series of slips in a tapered bowl, and a slip-setting yoke for pivotally setting the slips, said locking mechanism comprising:

a lock rod connected at one end to the yoke and having a hole;

a handle pivotally attached to the body;

a lock plunger, having a key slot and reciprocally mounted to move in a straight line between a locked position, in which the lock plunger extends into the hole in the lock rod, and a released position, in which the lock plunger is retracted;

a key, carried by the handle, and cooperative with the key slot, for moving the lock plunger reciprocally in response to pivotal movement of the handle;

a spring for biasing the lock plunger toward the released position; and stop means for restricting the distance the lock plunger can move away from the lock rod.

4. An improved elevator/spider, comprising:

a body;

a series of slips in a tapered bowl;

a slip-setting yoke for pivotally setting the slips;

a lock rod connected at one end to the yoke;

a handle, pivotally attached to the body;

a cylindrical lock plunger, having a key slot, and reciprocally mounted to move in a straight line between a locked position and a released position;

locking means, on the lock rod and cooperative with the lock plunger, for preventing movement of the lock rod whenever the lock plunger is in the locked position, and for releasing the lock rod whenever the lock plunger is moved to the released position;

a key, carried by the handle, and cooperative with the key slot of the lock plunger for moving the lock plunger reciprocally in response to pivotal movement of the handle;

a spring, mounted around the lock plunger, for biasing the lock plunger toward the released position; and stop means for restricting the distance the lock plunger can move away from the lock rod.

* * * * *